United States Patent [19]

Ennerdal et al.

[11] 4,171,557

[45] Oct. 23, 1979

[54] COUPLING DEVICE FOR SAFETY BELTS FOR VEHICLES

[76] Inventors: Leif Ennerdal, Glimmergatan 16, 441 00 Alingsås; Lars-Eije D. Berg, Torggatan 25, 440 20 Vårgårda, both of Sweden

[21] Appl. No.: 886,443

[22] Filed: Mar. 14, 1978

[30] Foreign Application Priority Data

Mar. 30, 1977 [SE] Sweden ..... 7703667

[51] Int. Cl.[2] ..... A44B 11/25

[52] U.S. Cl. ..... 24/230 AL

[58] Field of Search ..... 24/230 AL, 230 AK, 230 A, 24/230 AP, 230 AT

[56] References Cited

U.S. PATENT DOCUMENTS

| | | | |
|---|---|---|---|
| 3,146,846 | 9/1964 | Gutshall | 24/230 AT |
| 3,523,342 | 8/1970 | Spires | 24/230 AT |
| 3,955,056 | 5/1976 | Lindblad | 24/230 AL |
| 4,000,548 | 1/1977 | Stephenson et al. | 24/230 AL |
| 4,047,267 | 9/1977 | Lindblad | 24/230 AL |
| 4,065,836 | 1/1978 | Stephenson | 24/230 AL |

*Primary Examiner*—Kenneth J. Dorner

[57] ABSTRACT

Coupling device for safety belts for vehicles comprising a male part having catching surfaces thereon insertable in a female part having stop bolts engageable with said catching surface, a releasing member in said female part movable to a releasing position for disengaging said stop bolts from said surfaces, a spring loaded ejector member in said female part for ejecting said male part when said releasing member is moved to said releasing position, and a spring plate in said female part having an engaging portion to retain said releasing member in said releasing position, said ejector member cooperating with said spring plate such that when said male part is inserted into said female part said spring plate will be disengaged from said releasing member only when said catching surfaces of the male part have passed said stop bolts of the female part in the direction of insertion.

2 Claims, 4 Drawing Figures

Fig. 1
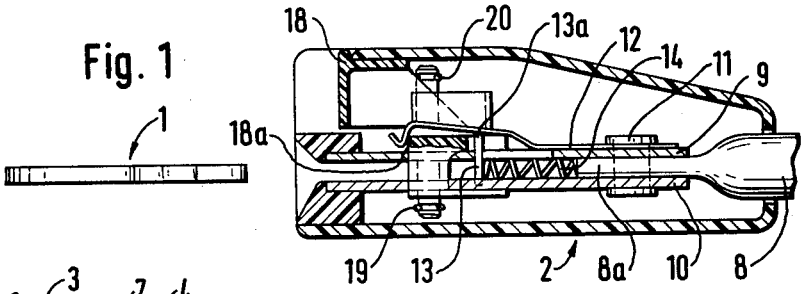
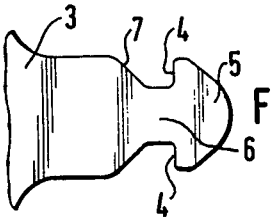
Fig. 1a
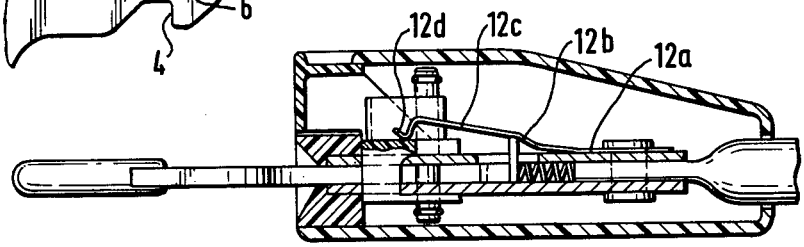
Fig. 2
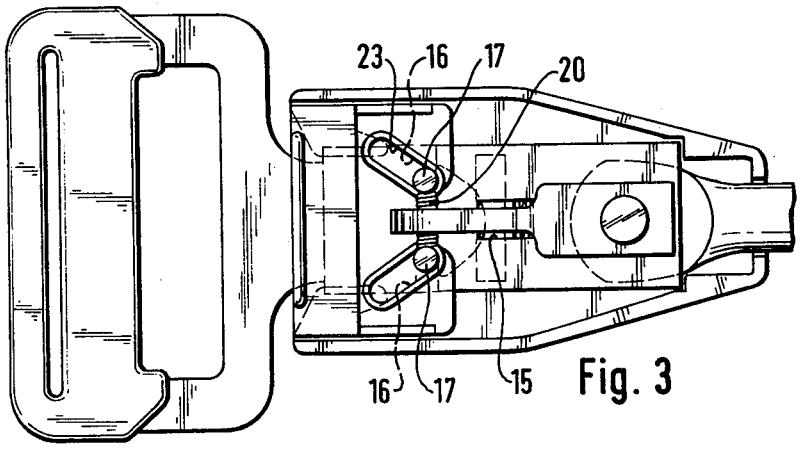
Fig. 3

COUPLING DEVICE FOR SAFETY BELTS FOR VEHICLES

The present invention relates to a coupling device for safety belts for vehicles, and comprises a male and a female part. In the female part a locking means is provided, which can cooperate with the male part by engaging the same and which by means of a releasing member can be released from such engagement. A spring loaded ejector member operates in the ejecting direction.

It is a principal object of the invention to provide a reliably functioning coupling device of the kind mentioned above, in which a partial locking can be prevented in an efficient manner. Partial locking is meant such a locking position, where the male part and female part unintentionally can be moved apart by a pull on these parts.

Said object is attained by a coupling device, which is substantially characterized by the female part comprising a holding means, which depending upon the extent of insertion of the male part in a certain position is guided in such a manner that, when inserting the male part, said holding means maintains the locking means, which by means of engagement cooperates with said male part, in a releasing position, until the male part has been introduced so far that an engagement catcher thereof has passed engagement stop bolts of the locking means.

In the following the invention will be described with reference to the accompanying drawings, in which FIG. 1 is a view of a longitudinal cross section through a coupling device made in accordance with the invention and shown in disengaged condition (FIG. 1*a* illustrates the male part as seen from above according to FIG. 1); and FIG. 2 is a view corresponding to the one in FIG. 1 but of a longitudinal cross section through the coupling device in coupled condition; and FIG. 3 is a top view according to FIG. 2 showing the coupling device with the upper portion of the casing enclosing the locking means of the coupling device removed.

The coupling device illustrated in the FIGS. 1–3 comprises two principal parts, i.e. a male part 1 and a female part 2 to which the male part can be coupled. The male part 1, which is intended to be coupled to a band (not shown) forming part of the safety belt of the vehicle in question has an arrow-shaped front end portion with backward facing catching surfaces 4, which are shaped by the passage between a comparatively wide nose portion 5 and a narrower neck portion 6, which via oblique edges 7 blends into a wider rear portion 3. The female part 2 comprises an anchoring bar 8, which has a flattened end portion 8*a*, the opposite end portion, not shown, in an in itself known manner being adapted to be fastened to the chassis of the vehicle. The bar 8 is preferably flexible and has such properties, that it remains in an adjusted inclined position for the desired accommodation of the female part 2. An upper plate 9 and a lower plate 10 are maintained at a certain distance from each other by means of the end portion 8*a* of the anchoring bar 8. The end portion 8*a* and the plates 9, 10 are held together by means of a rivet 11 through these parts, said rivet also holding one end portion of a plate spring 12. An ejector member 13 is movably mounted in the interspace between the plates 9 and 10, and a pressure spring 14 rests with one end against the ejector member 13 and with its other end against the anchoring bar 8. Thus, the spring tends to move the ejector member 13 to the left according to the drawing. The ejector member is guided in the plates by means of longitudinally extending slits, of which the slit 15 provided in the upper plate is best evident from FIG. 3. Two slits made in opposing sides of the plates are indicated with 16. Through each one of these slits a locking element 17 extends in a direction crosswise to the plates. Tension springs 19 and 20 respectively are stretched between the upper and lower ends respectively of the cylindrical locking elements 17, which tension springs strive to hold the locking elements in the position, in which they are brought together as illustrated in FIG. 3. A releasing element 18, which can be displaced along the plates, in sleeve like fashion encloses the unit shaped by the two plates 9 and 10. Oblique slits 23 are made in said releasing unit, which slits diverge in direction towards the front end of the female part. In the condition, which is evident from FIG. 3, in which the male and female parts are brought together, the locking elements 17 constitute stop bolts, which cooperate with the catcher surfaces 4 by engaging them from behind. When the releasing member 18 is moved in backwards direction, a compulsory displacement of the locking elements 17 takes place in direction away from each other, whereby their engagement with the male part ceases and the ejector member 13 ejects the male part under the bias of the pressure spring 14. When the male part is introduced, its nose portion 5 forces the locking elements 17 apart against the bias of the springs 19, 20 and a compression of the pressure spring 14 takes place, before the locking elements snap in behind the nose portion of the male part. As mentioned above the plate spring 12 has one end portion attached to the upper plate 9 by means of the rivet 11. This end portion 12*a* extends parallel to the plate 9 and merges with to a portion 12*b*, which in a comparatively sharp manner diverges from the plate and in its turn merges with to still another portion 12*c*, which also diverges from the plate, but at a somewhat smaller angle. The portion 12*c* merges with to a hook-shaped end portion 12*d*, which in FIG. 1 is shown in engagement with a shoulder 18*a* provided at the front end of the releasing member 18. The ejector organ 13 has a portion 13*a*, which projects in upwards direction through the slit 15 in the plate so far that, when the male part is introduced into the position illustrated in FIG. 2, it cooperates with the portion 12*c* or 12*b* of the plate spring, so that this spring is lifted up from the position illustrated in FIG. 1. The tension of the plate spring is adjusted in such a manner that due to the springing property of the material it tends to occupy the position illustrated in FIG. 1. The hook-shaped end portion 12*d* has such a shape that it cannot remain in any intermediate position between the two positions illustrated in the FIGS. 1 and 2. The springs 19, 20 via the locking elements 17 tend to move the releasing member 18 to its position illustrated in FIG. 2. However, when the male part has been ejected out of the female part, the releasing member 18 is maintained in pushed-in, i.e. the retrograded position of the spring 12, as is shown in FIG. 1. When the male part is introduced into the female part, the locking elements 17 are thus moved apart, and the front end of the male part presses the ejector member 13 in direction to the right against bias of the pressure spring 14, whereby the projection portion 13*a* of the ejection member by striking against the spring portions 12*c*, 12*b* forces the plate spring in direction away from the plate 9 and thereby lifts the end portion 12*d* from the shoulder 18*a*, whereby the releasing element is released and moves in direction to the left under bias of the springs 19, 20, which also contract the locking elements 17 towards the neck portion 6 of the male part behind the catcher faces 4. The position of the ejector portion 13*a* and the shape of the plate spring portions 12*c* and 12*b* are arranged so that the releasing of the releasing member 18 does not take place until the catcher surface 4 of the male part has passed the locking elements 17. When the releasing member 18 is pushed inwards, i.e. moved from the position illustrated in FIG. 2, and so far that the locking elements 17 release the nose portion of the male part, the plate spring again snaps in front of the shoulder 18*a* of the releasing member, whereby the releasing organ is held back in this position until the male part again has been introduced. Because of the releasing member remaining in its pushed-in position as long as an effective locking of the male part has not taken place, a clear indication is obtained whether the male part has been completely pushed-in or not.

By means of the device illustrated, it is ensured that a partial locking will not take place. This means that the male part cannot be locked only partially and be released unintentionally in connection with a pull an the male part, something that for.

The invention is not limited to the embodiment described above and illustrated in the drawings by way of example only, but can be varied as to its details within the scope of the following claims without therefore departing from the fundamental idea of the invention. Thus, the invention can be applied in connection with other types of locking devices. In order to facilitate the passage of the hook-shaped end portion of the spring 12 between its two positions, said end portion can be provided with a roller, which still further diminishes the risk of a partial locking in any intermediate position.

We claim:

1. Coupling device for safety belts for vehicles comprising a male part having catching surfaces thereon, a female part having locking means therein comprising stop bolts for engagement with said catching surfaces, said male part being movable along a path of travel in said female part when inserted therein to engage said bolts with said surfaces, a releasing member in said female part movable to a releasing position for disengaging said stop bolts from said catching surfaces and having a portion which is displaceable along said path of travel, an ejector member in said female part in said path of travel, a spring in said female part biasing said ejector member against said male part when the latter is inserted into said female part, and holding means in said female part comprising a spring plate extending along said path of travel, one end of said plate being attached to said female part and its other end being pivotable in a direction towards and away from said portion of said releasing member and being provided with an engaging portion designed due to the springing property of the spring plate to engage and retain said portion of said releasing member when the latter is moved to said releasing position, and said ejector member having a portion which cooperates with said spring plate in such a manner that when said male part is inserted into said female part and moved into contact with said ejector member against the bias of said spring, said spring plate will be lifted out of engagement with said portion of said releasing member only when said catching surfaces of the male part have passed said stop bolts of the female part in the direction of insertion.

2. Coupling device according to claim 1, wherein said stop bolts are spring biased to engage with said catching surfaces when the male part is inserted into said female part and cooperate with said releasing member to move the latter out of said releasing position when said engaging portion of said spring plate is lifted out of engagement with said portion of said releasing member.

* * * * *